US007192297B1

(12) United States Patent
Wu

(10) Patent No.: US 7,192,297 B1
(45) Date of Patent: Mar. 20, 2007

(54) CABLE CONNECTOR ASSEMBLY WITH IMPROVED SHELL

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,668

(22) Filed: Jul. 5, 2006

(51) Int. Cl.
*H01R 13/627* (2006.01)

(52) U.S. Cl. ..... 439/358; 439/353; 439/680; 439/607

(58) Field of Classification Search ..... 439/350–358, 439/607, 610, 680
See application file for complete search history.

(56) References Cited

U.S. PATENT DOCUMENTS 5,213,533 A 5/1993 Walden
5,727,963 A 3/1998 Lemaster
5,775,931 A 7/1998 Jones
5,860,826 A 1/1999 Chang
5,941,726 A 8/1999 Koegel et al.
6,099,339 A 8/2000 Yanagida et al.
6,210,202 B1 4/2001 Kuo
6,558,183 B1 5/2003 Ji et al.
6,565,383 B1 5/2003 Wu
6,585,536 B1 7/2003 Wu
6,585,537 B1 7/2003 Lee
6,786,755 B2 9/2004 Dambach et al.

*Primary Examiner*—Javaid H. Nasri
(74) *Attorney, Agent, or Firm*—Wei Te Chung

(57) ABSTRACT

A cable connector assembly (100) includes a connector housing (1) defining an L-shaped port and a rectangular port, a number of contacts (2) received in the connector housing, a cable (4) with a number of conductors electrically attached to the contacts, a pair of locking members (9) retained in the connector housing, and a shell (6) enclosing the connector housing and electrically connected to the contacts, and a cover (7) enclosing the rear of the connector housing.

16 Claims, 10 Drawing Sheets

CABLE CONNECTOR ASSEMBLY WITH IMPROVED SHELL

CROSS-REFERENCE

This application is related to U.S. patent application Ser. No. 10/787,661, filed on Feb. 25, 2004 and entitled "CABLE CONNECTOR ASSEMBLY HAVING LOCKING MEMBER" which has the same applicant and assignee as the present invention.

BACKGROUND OF THE INVENTION

1. Field of the Invention

The present invention relates to a cable connector assembly, and more particularly to a cable connector assembly used for high-speed signal transmission.

2. Description of Related Art

Electrical connectors are used in a wide variety of applications. Some connectors simply are used to transmit power from a power source to an appropriate appliance. Other electrical connectors are used to interconnect signal transmission lines to printed circuit boards, other electronic devices or to other complementary connectors. The transmission lines transmit signals through a plurality of conductors which, preferably, are physically separated and electromagnetically isolated along their length. Hybrid connectors are known in which both power and signals and/or data are transmitted through the connector interface.

Some electrical connectors also employ various types of shield structures, ground structures or the like to protect or to electrically interact with the transmission lines and their terminals within the connectors. For instance, some connectors are provided with shield structures to protect against electrostatic discharges (ESD) which are generated when the connector comes into contact with another conductive body which may be a complementary mating connector. In essence, the ESD shield is used to dissipate static charges. Further, connectors also may have shield structures to protect against electromagnetic interference (EMI). In essence, the EMI shield protects the electrical circuitry from externally generated radiated emissions as well as preventing electromagnetic interference from radiating outwardly of the connector. So, the structure of the shield is important and maybe influences the effect of the shield to protect against EMI and ESD.

In present invention, a cable connector assembly with improved shell is provided.

SUMMARY OF THE INVENTION

An object of the present invention is to provide a cable connector assembly having an improved shell to protect against EMI (electromagnetic interference)and/or ESD (electrostatic discharge).

Another object of the present invention is to provide a cable connector assembly with the shell being reliably engaged with the connector housing.

To achieve the above objects, a cable connector assembly in accordance with the present invention comprises a connector housing defining a mating interface and a connecting interface opposite to the mating interface, and having a plug receiving space for receiving a mating portion of the complementary connector, a contact receiving space communicated with the plug receiving space, and a pair of lateral portions respectively located at lateral thereof and defining a retention cavity, a plurality of contacts, each contact comprising a mating end received in the contact receiving space and exposed to the plug receiving space, a tail end rearwardly extending beyond the connecting interface, a cable comprising at least a signal conductor, and a grounding conductor that are soldered to the tail ends of the contacts, a shell assembled to the connector housing from the mating interface of the connector housing, a cover enclosing the rear end of the connector housing and the shell and defining a pair of side portions, each side portion comprising a retention channel communicated with the retention cavity of the connector housing, and a pair of locking members, each locking member comprising a housing retention section received in the retention cavity of the connector housing, a cover retention section received in the retention channel of the cover, and a latch section for releasably locking with the complementary connector.

Other objects, advantages and novel features of the invention will become more apparent from the following detailed description when taken in conjunction with the accompanying drawings.

DETAILED DESCRIPTION OF THE INVENTION

Figure 1:
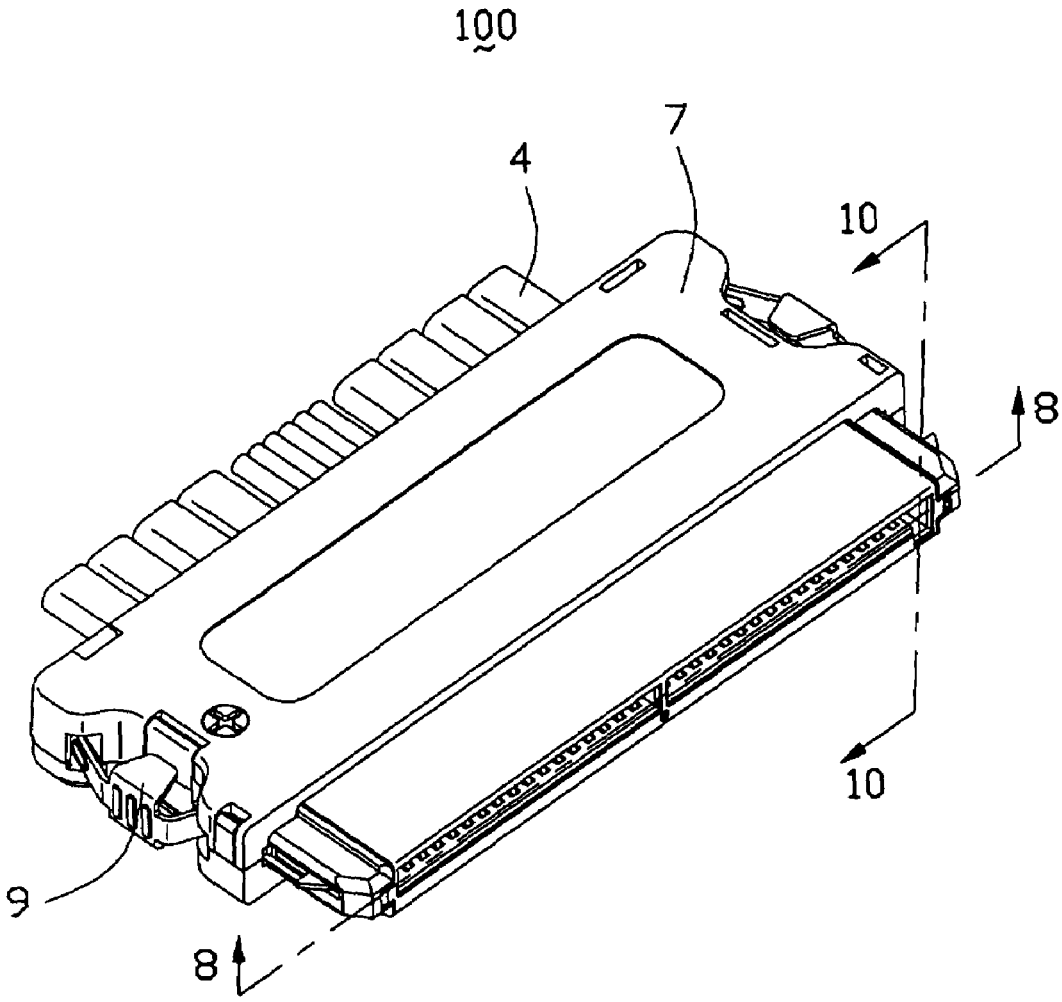
FIG. 1 is an assembled, perspective view of a cable connector assembly in accordance with the present invention.

Referring to FIGS. 1 to 4, a cable connector assembly 100 in accordance with the present invention comprises a connector housing 1 defining a mating direction, a plurality of contacts 2 received in the connector housing 1, a spacer 3 assembled to the connector housing 1, a plurality of cables 4 connected to the contacts 2, a flat board 5, a shell 6 enclosing the connector housing 1, a pair of locking members 9 retained in the connector housing 1, and a cover 7. In a preferred embodiment, the cable connector assembly 100 accords with a Serial ATA II standard. However, in alternative embodiments, the cable connector assembly 100 could be provided as other types.

Figure 8:
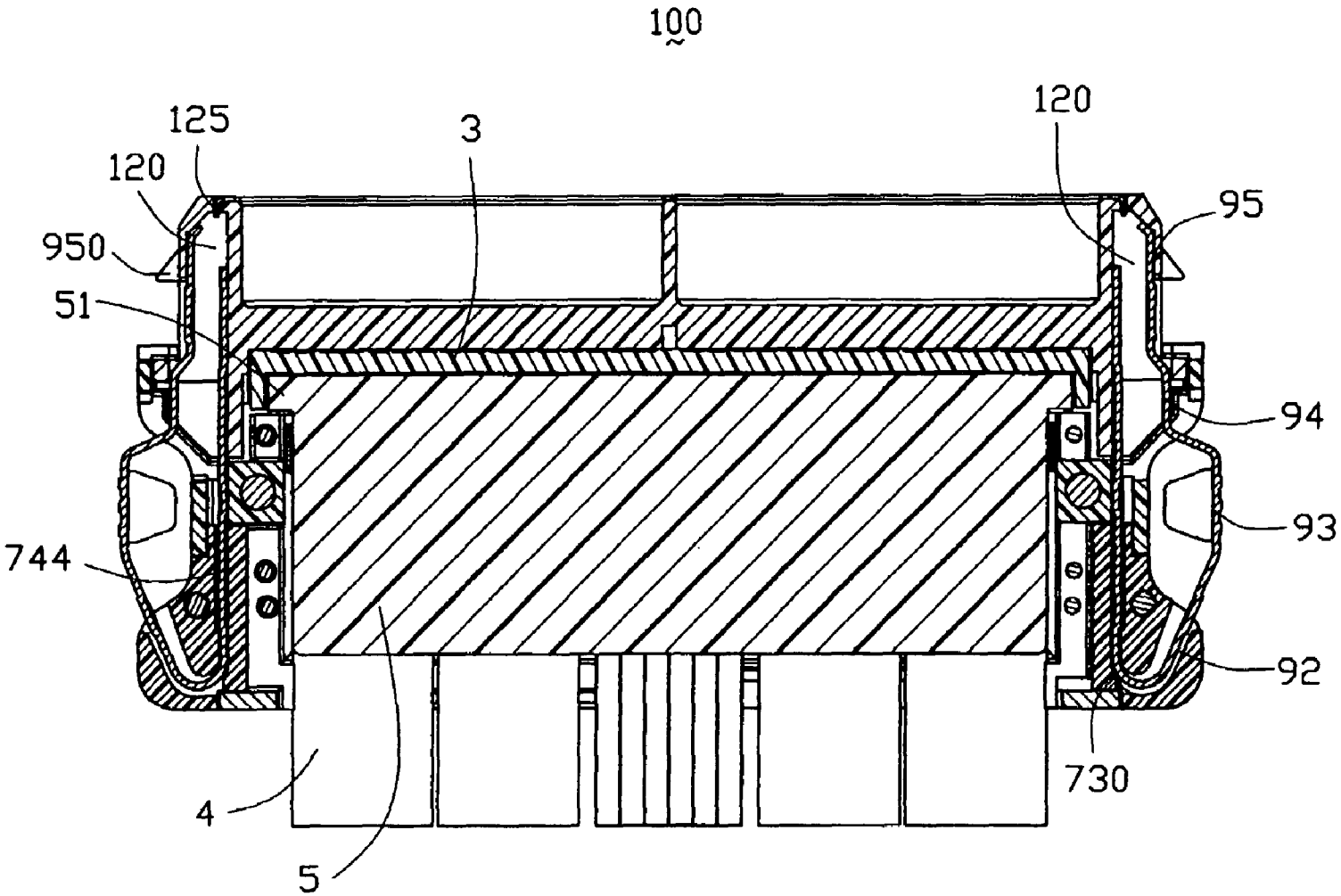
FIGS. 8 and 10 are cross-sectional views taken along lines 8—8, 10—10 of FIG. 1.

Referring to FIGS. 1–4, the connector housing 1 is substantially rectangular shape and, defines a mating interface 13, and a connecting interface 14, and comprises an upper wall 10, a lower wall 11 opposite to the upper wall 10, and a pair of lateral portions 12 connecting with the upper and lower walls 10, 11. Between the upper and lower walls 10, 11, the connector housing 1 defines a plug receiving space 15, a plurality of contact receiving passageways 18 communicated with the plug receiving space 15, and a spacer receiving opening 19 disposed behind the contact receiving passageways 18. The plug receiving space 15 is divided into an L-shaped first port 150 and a rectangular second port 151 by a vertically extended partition wall 152 for receiving complementary connector with different profiles. A protruding 153 is formed on the extended partition wall 152 and adjacent to the upper wall 10. Both the upper and lower walls 10, 11 form a plurality of protrusions 17 on external surfaces thereof and adjacent to the connecting interface 14. Each lateral portion 12 with one free end extending beyond the connecting interface 14 defines a retention cavity 120 (shown in FIG. 8) therein, a slit 121 communicated with the retention cavity 120 and disposed at front thereof, a ⊓-shaped frame 122 formed at rear thereof and opposite to the retention cavity 120, and a pair of blocks 124 arranged at two sides of each ⊓-shaped frame 122. In particular, each lateral portion 12 further forms a cabined slit 125 rearwardly depressed from the mating interface 13 and communicated with the retention cavity 120.

Figure 2:
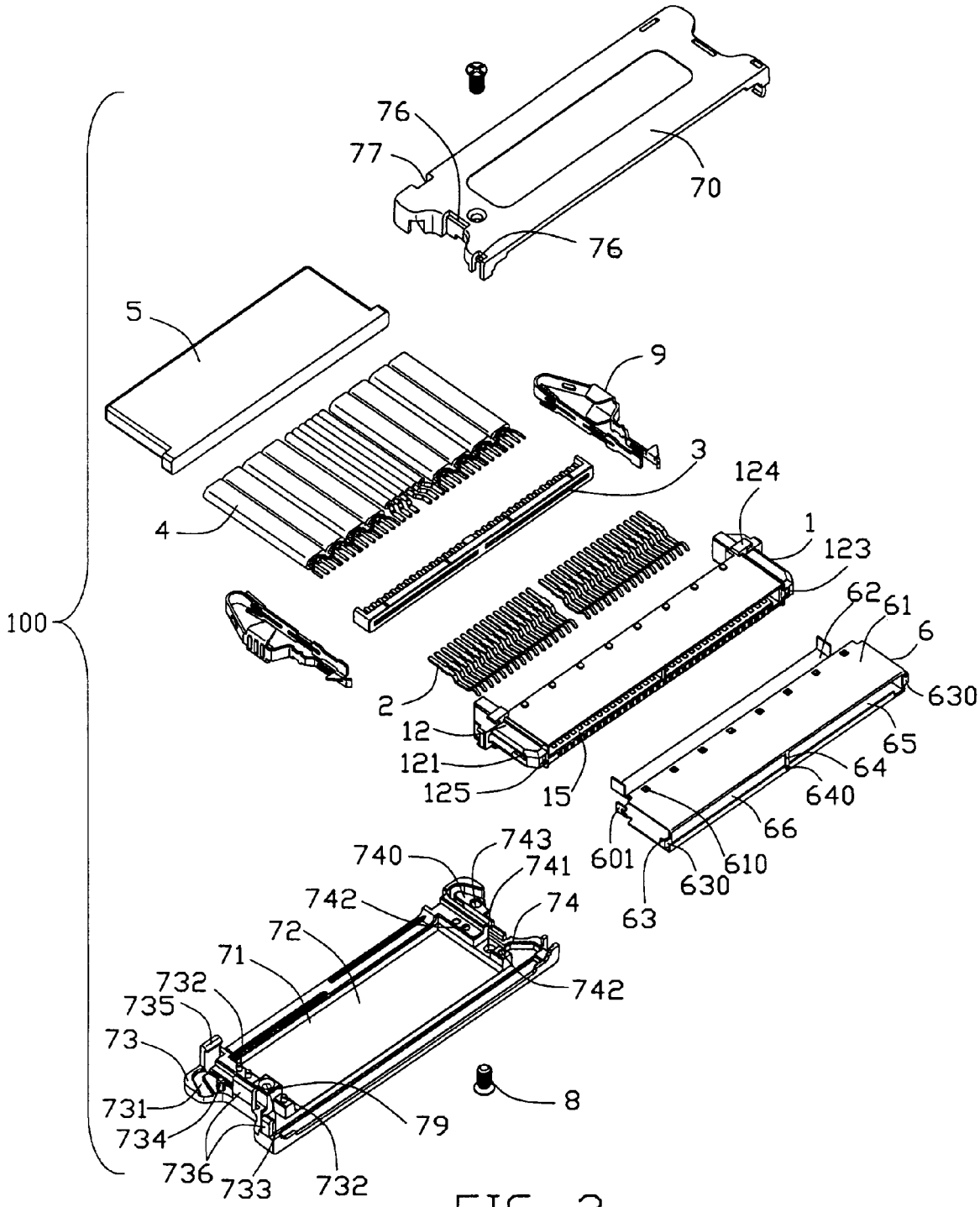
FIG. 2 is an exploded, perspective view of the cable connector assembly shown in FIG. 1.
Figure 3:
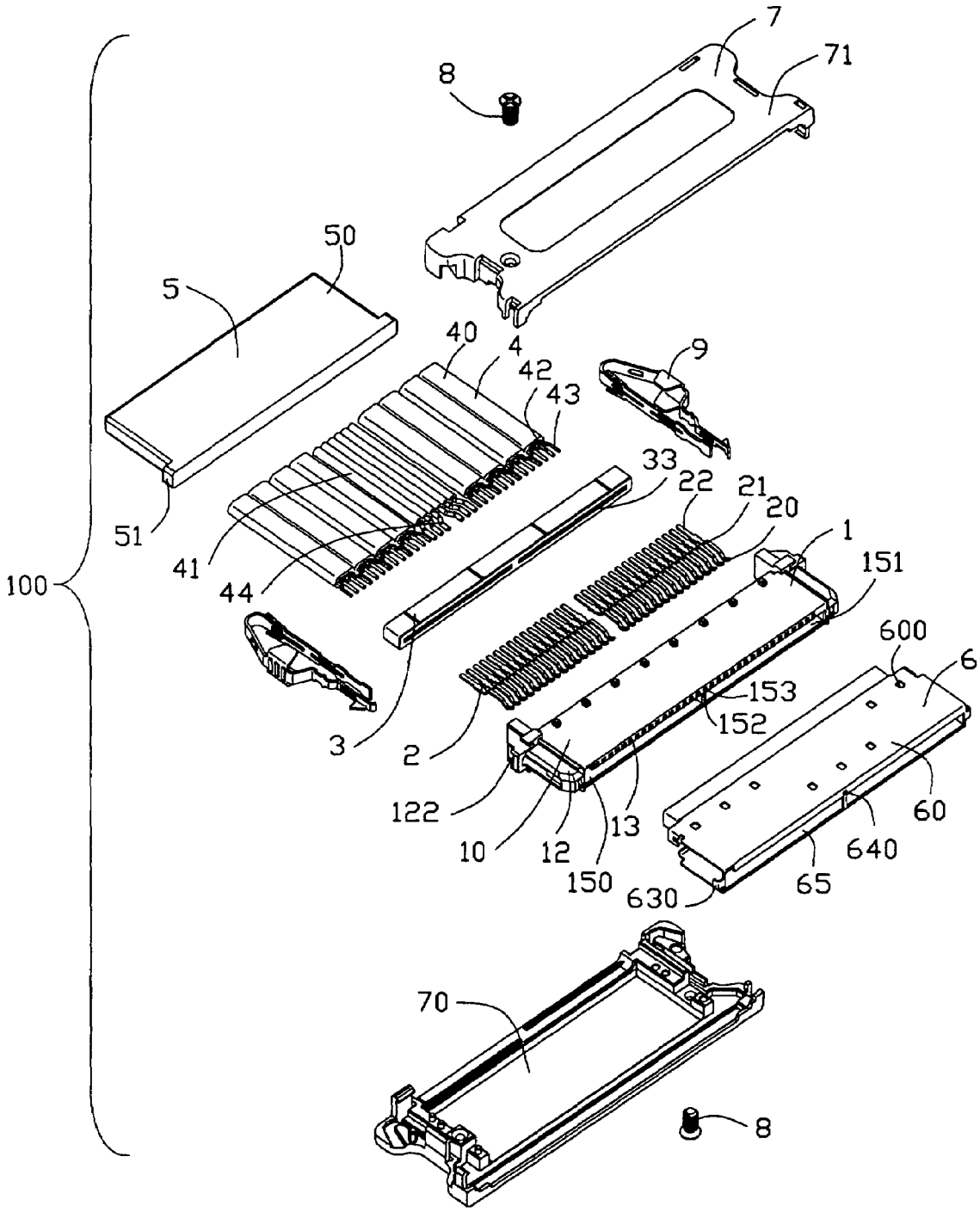
FIGS. 3–4 are views similar to FIG. 2, but taken from different aspects.
Figure 4:
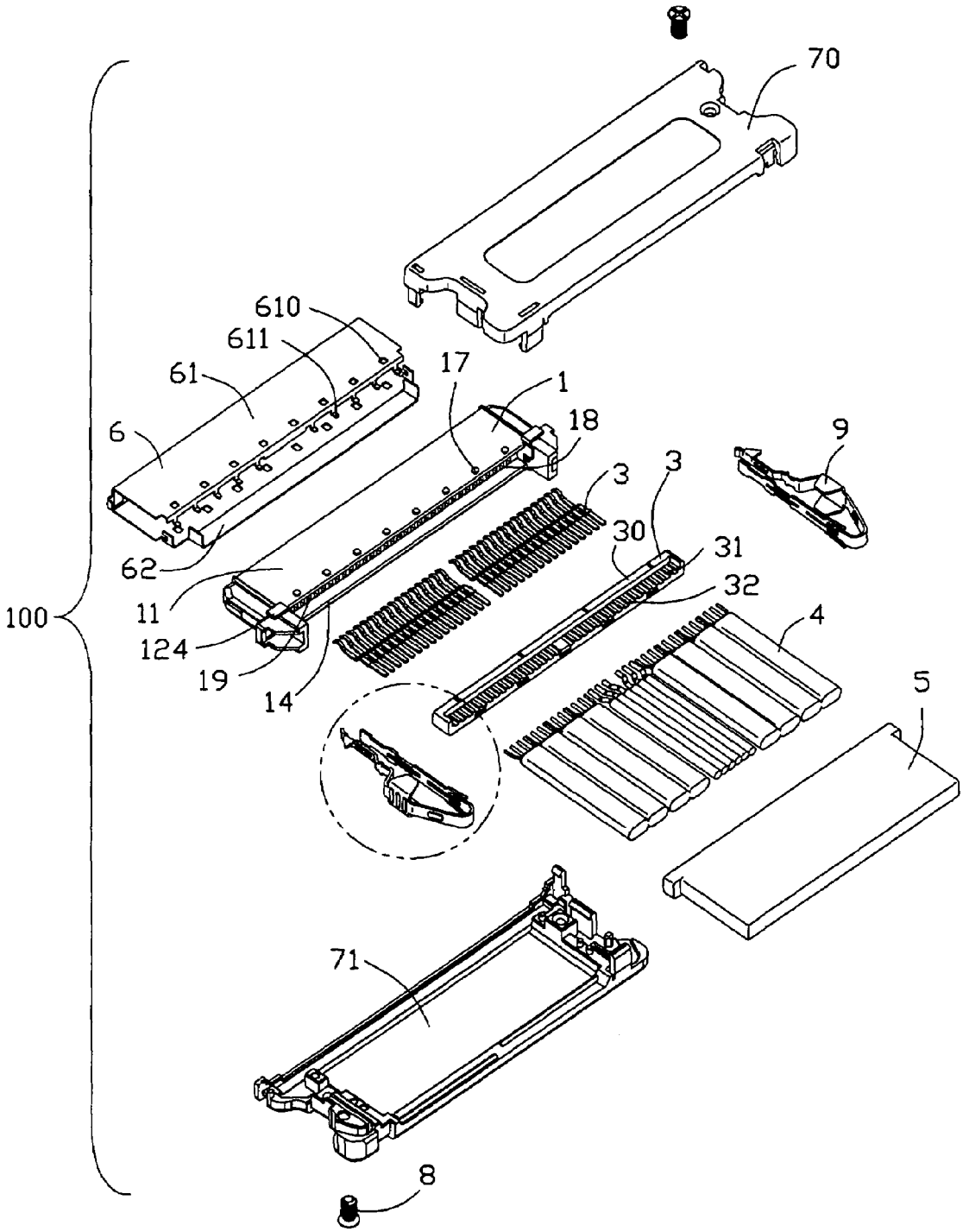
Figure 5:
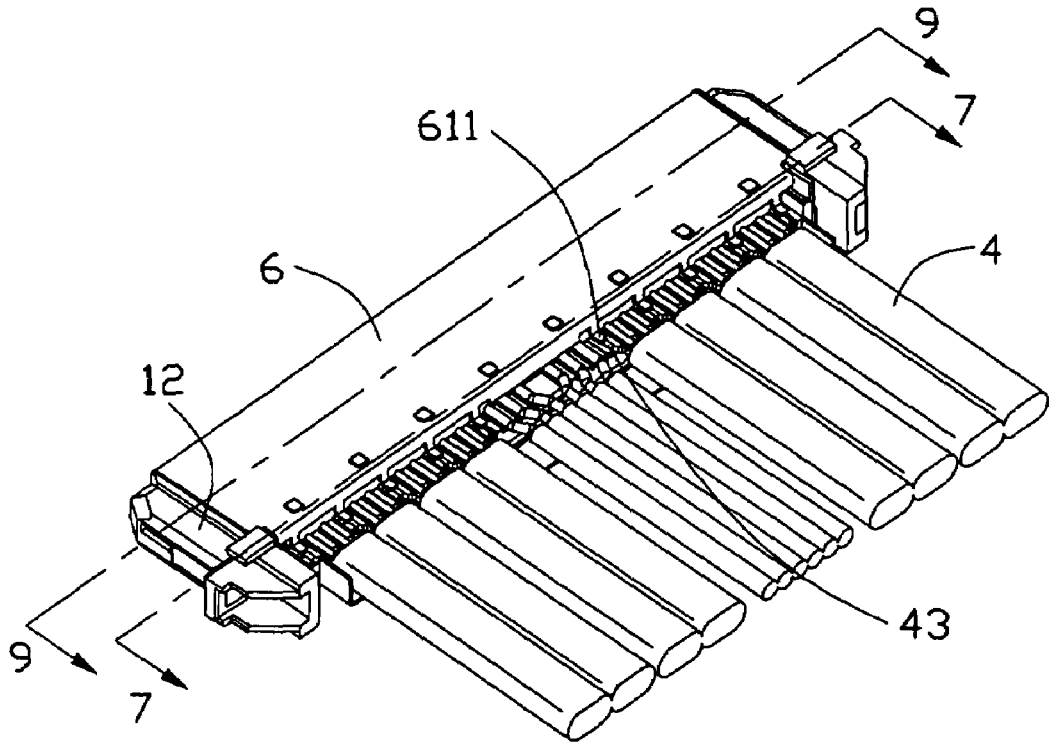
FIG. 5 is partially assembled, perspective view of the cable connector assembly shown in FIG. 3.

Referring to FIGS. 2–4, the contacts 2 are inserted in the passageways 18 of the connector housing 1 from the connecting interface 14 and each contact 2 comprises a mating end 20, a tail end 22 and a housing retaining portion 21 connecting the mating end 20 and the tail end 22. The mating ends 20 extend into the L-shaped first port 150 and the rectangular second port 151 of the plug receiving space 15 of the housing 1, respectively. The housing retaining portions 21 are secured within the passageways 18 of the connector housing 1 by an interference fit manner.

The spacer 3 is mounted to the spacer receiving opening 19 of the connector housing 1, and comprises a base 30 with a plurality of through holes 33 for allowing the tail ends 22 of the contacts 2 to extend therethrough, and a U-shaped positioning portion 31 with a plurality of grooves 32 for supporting the tail ends 22 of the contacts 2. The spacer 3 can prevent plastic material or other objects from entering into the passageways 18 of the connector housing 1. The contacts 2 and the spacer 3 can be integrally formed before mounting to the connector housing 1, if desired.

The cables 4 comprise four pairs of first 4-lane stacked Serial ATA cables 40 and six single-ended cables 41 located between the first 4-lane cables 40. Each first cable 40 comprises two pair of signal conductors 42, and two pair of grounding conductors 43 respectively arranged at two sides of the pairs of signal conductors 42. Each cable 41 comprises an inner conductor 44 enclosed by an outer jacket (not labeled). All front ends of the conductors 42, 43 and 44 are exposed outside and extend towards the spacer 3 for being soldered to corresponding tail ends 22 of the contacts 20.

The flat board 5 is made of PVC material, or other insulative material during a mold process, and comprises a flat main portion 50, and a pair of ribs 51 laterally extending from two lateral and front edges of the main portion 50.

Figure 6:
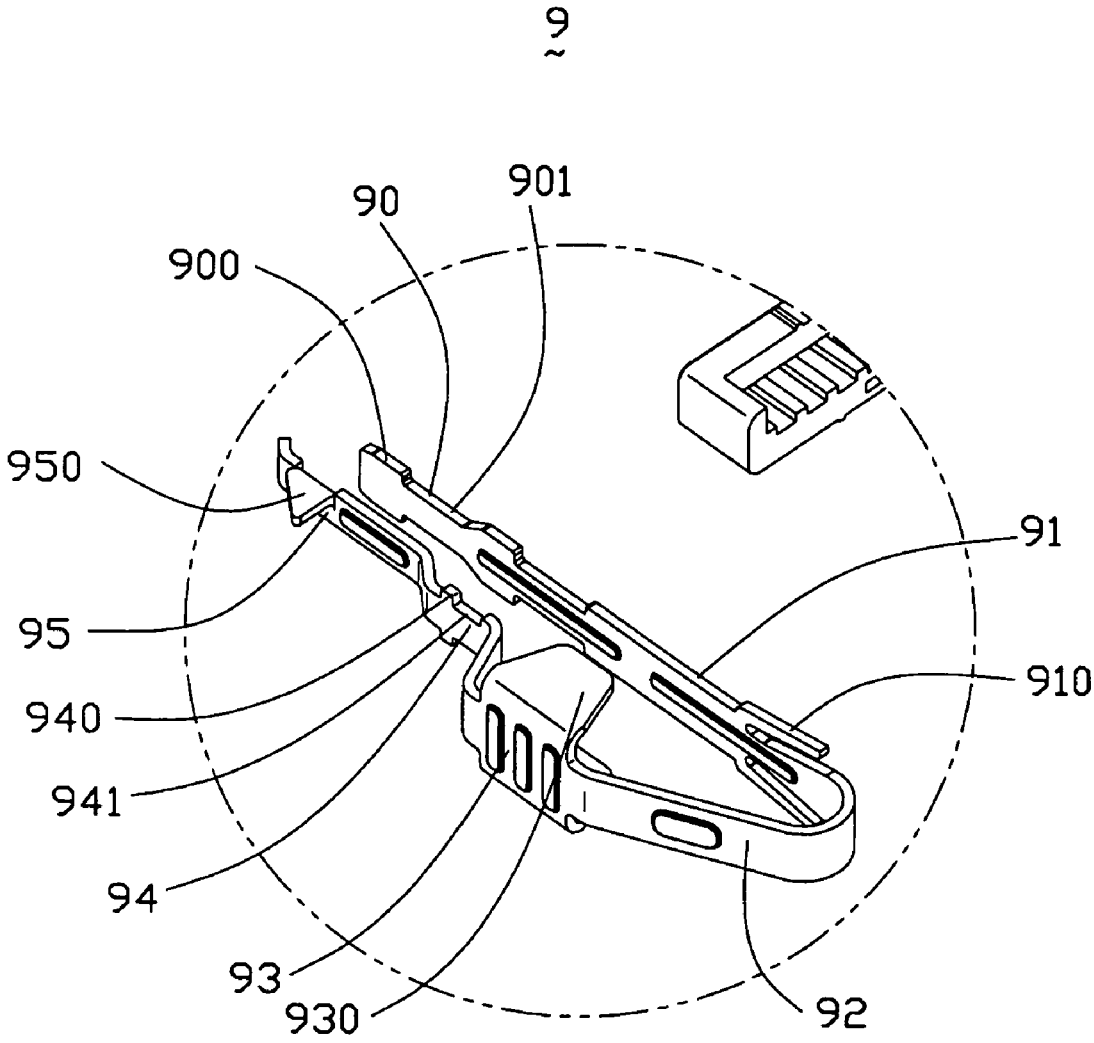
FIG. 6 is an enlarge view of a locking member shown in FIG. 4.
Figure 7:
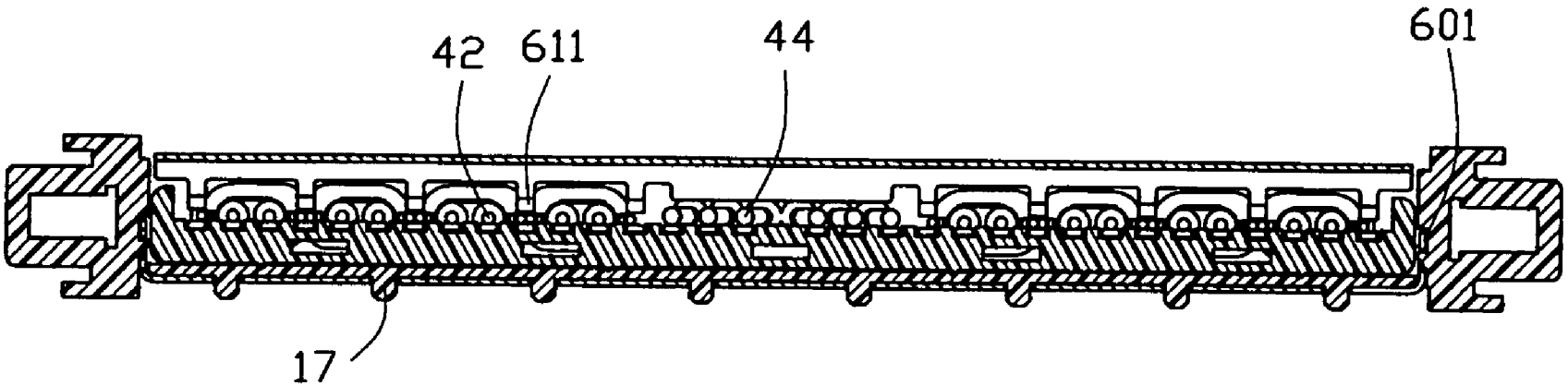
FIGS. 7 and 9 are cross-sectional views taken along lines 7—7, 9—9 of FIG. 5.

Referring to FIG. 6, each locking member 9 is stamped and formed from a metallic plate and comprises an elongate housing retention section 90 extending along the mating direction, a cover retention section 91 extending rearwardly from the housing retention section 90, a spring section 92 extending slantways from the cover retention section 91, a flat pushing section 93 extending forwardly from the spring section 92, an L-shaped positioning section 94 extending forwardly from the pushing section 93, and a latch section 95 extending forwardly from the positioning section 94. The housing retention section 90 is partially cut to form two pairs of recesses 901, thus also forms a pair of retention tabs 900 at front thereof. The cover retention section 91 defines a pair of retention tabs 910 slantways extending from opposite upper and lower edges thereof for engaging with the cover 7. A pair of stopping sections 930 extends towards to the cover retention section 91 from opposite sides of the pushing section 93. The positioning section 94 comprises a pair of positioning tabs 940 and a pair of recesses 941 for assuring fixed assembly. The latch section 95 comprises a locking tab 950 bent and extending outwardly from one edge thereof.

Referring to FIGS. 2–4, the shell 6 is stamped and made of metal piece, comprises a rectangular upper piece 60, a lower piece 61 opposite to the upper piece 60, and a U-shaped extending piece 62 rearwardly extending from a rear edge of the upper piece 60. Between the upper piece 60 and the lower piece 61, the shell 6 comprises a pair of vertical pieces 63, and a middle piece 64 parallel to the vertical piece 63, by which the upper and lower pieces 60, 61 connect to each other. Further, the shell 6 defines an L-shaped mating port 65, and a rectangular mating port 66 partitioned with the L-shaped mating port 65 by the middle piece 64. Each vertical piece 63 comprises a spring tab 630 rearwardly bent for mating with the cabined slit 125. The middle piece 64 defines an aperture 640 aligned with the protruding 153. In particular, the upper piece 60 defines a pair of curved pieces 601 uprightly bent from rear edges thereof, and a plurality of rectangular first holes 600 located between the pair of the curved pieces 601 for mating with corresponding protrusions 17 of the connector housing 1. The lower piece 61 comprises a plurality of rectangular second holes 610 opposite to the first holes 600, and a plurality of L-shaped spring fingers 611 extending from rear edge thereof for electrically connecting to the grounding conductors 43 of the contacts 4.

Figure 9:
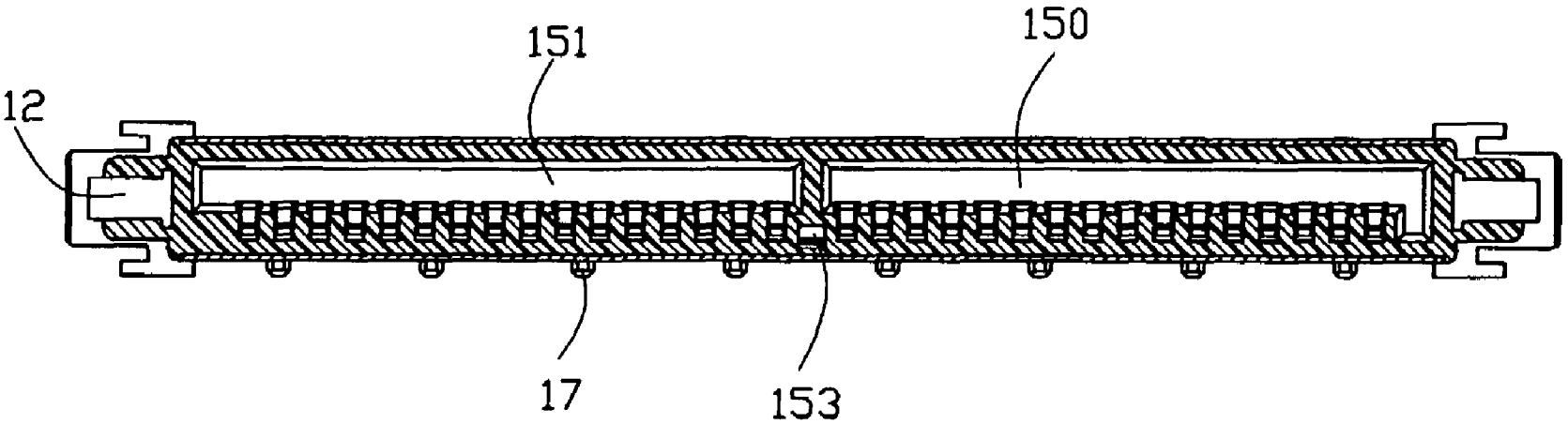
Figure 10:
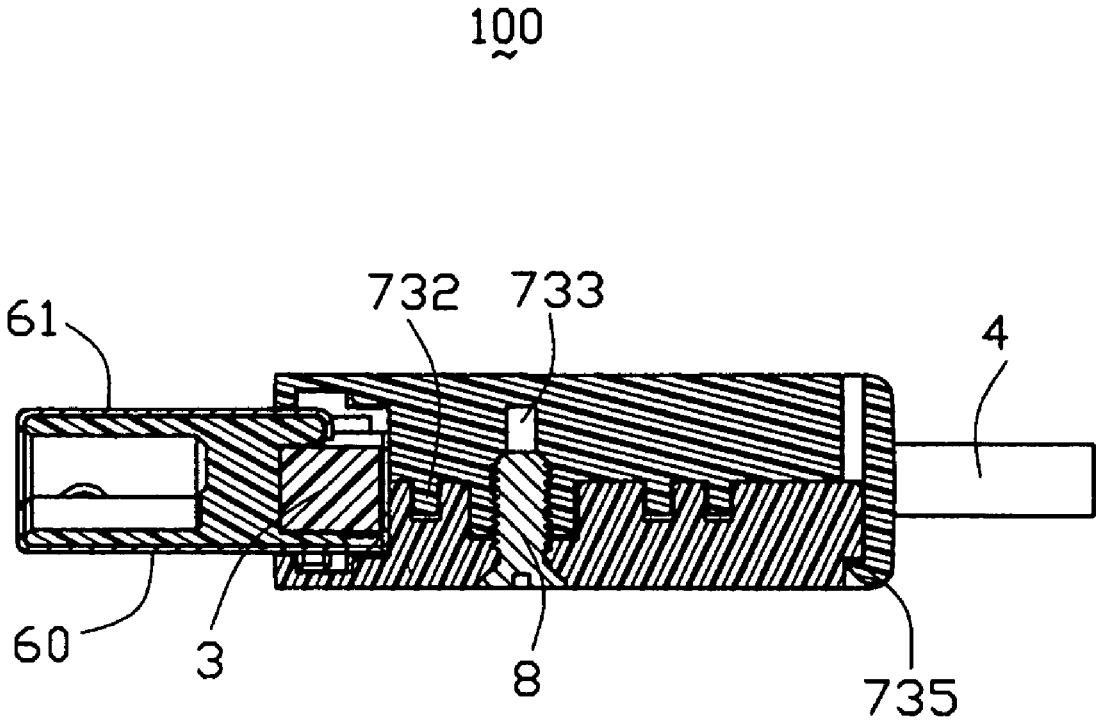

Referring to FIG. 2, the cover 7 comprises a first cover piece 70, and a second cover piece 71 engaged with the first cover piece 70. The first cover piece 70 is same to the second cover piece 71 in structure by clockwise rotating the second cover piece 71 with 180 degree. Next, the second cover piece 71 is introduced hereinafter, and the introduction to the first cover piece 70 is omitted. The second cover piece 71 comprises a substantially rectangular main portion 72, a first side portion 73 located at one end of the main portion 72, and a second side portion 74 located at the other end of the main portion 72. The first side portion 73 defines a narrow first channel 730 (shown in FIG. 8) for allowing the cover retention section 91 of the latching member 9 to receive therein, and a second channel 731 communicated with the channel 730 and slantwise extending towards exterior space for allowing the spring section 92 to be received therein. A stepped portion 79 is disposed at one lateral side of the first channel 730, and comprises at least three protrusions 732 thereon and aligned in one row, and a columnar recess 733 located between the protrusions 732. Further, a post 734, a pair of first locking bars 736 are located at the other lateral side of the first channel 730, and a second locking bar 735 is located at one end of the first channel 730. Noticeably, the pair of first locking bars 736 and the second locking bar 735 lock with the complementary components of the first cover piece 70. The second lateral portion 74 comprises a narrow third channel 744 (shown in FIG. 9) cooperated with the first channel 730 of the first cover piece 70 to receive the cover retention section 91, and a recessed port 740 cooperated with the second channel 731 to receive the spring section 92. At least three holes 742 are formed at one lateral side of the third channel 744 and aligned with the protrusions 732 of the first cover piece 70, and a depressed portion (not labeled) with a recessed through hole 741 formed therein is located between said protrusions 732. Further, another hole 743 is formed within the recessed port 740. Referring to FIG. 2, the first cover piece 70 comprises a pair of locking pieces 76 formed at a lateral edge thereof and aligned with the pair of locking bars 736, and a second locking piece 77 formed at a longitudinal side thereof and aligned with the second locking bar 735. The first cover piece 70 also defines a main portion, a first lateral portion and a second lateral portion that are respectively located at two sides of the main portion. The first lateral portion of the first cover piece 70 is same as the second lateral portion 74 of the second cover piece 71 in structure, and can mate with the second lateral portion of the second cover piece 71. Similarly, the second lateral portion 73 of the first cover piece 70 is same to the first lateral portion of the second cover piece 71, and can mate with the first lateral portion of the second cover piece 71.

Referring to FIGS. 1–10, in assembly of the cable connector assembly 100, the contacts 2 are inserted in the spacer 3, with the tail ends 22 supported by the U-shaped positioning portion 31. Then, the contacts 2 with the spacer 3, are together pushed into the spacer receiving opening 19 of the connector housing 1, with the mating ends 20 of the contacts 2 exposed in the L-shaped first port 150 and the rectangular second port 151. The sets of the cables 4 are soldered to the tail ends 22 of the contacts 2, with every two adjacent grounding conductors 43 soldered to the same tail end 22. Then, referring to FIG. 8, the flat board 5 is assembled to the spacer 3, with the ribs 51 received in the U-shaped positioning portion 31. Next, the shell 6 mates with the connector housing 1 in a front-to-rear direction, and encloses the connector housing 1. The upper and lower pieces 60, 61 of the shell 6 reliably engage with the upper and lower walls 10, 11 of the connector housing 1 by means of the connections between the first and second holes 600, 610 and the protrusions 17. In particular, the spring tabs 630, and the aperture 640 of the shell 6 respectively engage with the cabined slits 125, and the protruding 153 of the connector housing 1. Then, the spring fingers 611 are soldered to the grounding conductors 43 of the cables 4 to protect the electrical connections against EMI and ESD.

Referring to FIGS. 1–10, the locking members 9 are pushed into and mates with the lateral portions 12 of the connector housing 1 in the rear-to-front direction. The housing retention sections 90 are inserted into the retention cavities 120 with the locking tab 950 extending through the slit 121 and exposed outside and the positioning tabs 940 interferentailly fitted with the ⊓-shaped frame 122 of the connector housing 1. Then, the flat board 5 is molded with the joints of the contacts 2 and the cables 4 for providing a reliable connection therebetween. In addition, a flat board 5 can be pre-molded in a mold, and then assembled to the spacer 3.

Referring to FIGS. 1–10, the first and second covers 70, 71 are assembled to the connector housing 1 from the upper and lower sides of the connector housing 1. During this assembly, the cover retention sections 91 are received in the first channels 730, the spring sections 92 are received in the second channels 731, all protrusions 732, 734 are received in corresponding holes 742, 743, and the locking bars 735, 736 respectively lock with the locking pieces 77, 76, thereby establishing a reliable connection between the two cover pieces 70, 71. In addition, the columnar recesses 733 of the first cover piece 70 are aligned with the through holes 741 of the second cover piece 71. The screws 8 are respectively pushed into the recessed through holes 741 of the first cover piece 70 and then engaged with the through holes 733 of the second cover piece 71. When the cable connector assembly 100 engages/disengages with the complementary connector, a user can press the flat pushing sections 93, and thereby driving the locking tabs 950 inwardly to mate/unmate with apertures of the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for mating with a complementary connector, comprising:

a connector housing defining a mating interface and a connecting interface opposite to the mating interface, and having a plug receiving space adapted for receiving a mating portion of the complementary connector, a contact receiving space communicating with the plug receiving space, and a pair of lateral portions respectively located at opposite lateral sides thereof and defining a retention cavity;

a plurality of contacts, each contact comprising a retaining portion reliably received in the contact receiving space, a mating end exposed to the plug receiving space, and a tail end rearwardly extending beyond the connecting interface;

a cable comprising at least a signal conductor, and a grounding conductor respectively soldered to the tail ends of the contacts;

a shell assembled to the connector housing from the mating interface of the connector housing;

a cover enclosing the rear ends of the connector housing and the shell, the cover defining a pair of side portions, each side portion comprising a retention channel communicated with the retention cavity of the connector housing; and a pair of locking members, each locking member comprising a housing retention section received in the retention cavity of the connector housing, a cover retention section received in the retention channel of the cover, and a latch section for releasably locking with the complementary connector.

2. The cable connector assembly as claimed in claim 1, wherein the shell is stamped and made of metal piece, and comprises a rectangular upper piece, a lower piece opposite to the upper piece, and a U-shaped extending piece rearwardly extending from a rear edge of the upper piece.

3. The cable connector assembly as claimed in claim 2, wherein at least one of the upper piece and the lower piece of the shell comprises at least one hole, and the connector housing comprises at least one protrusion for locking with said hole of the shell for establishing a reliable connection therebetween.

4. The cable connector assembly as claimed in claim 2, wherein the plug receiving space of the connector housing is divided into an L-shaped first port and a rectangular second port by a vertically extended partition wall for receiving complementary connector with different profiles.

5. The cable connector assembly as claimed in claim 4, wherein the shell comprises a pair of vertical pieces, and a middle piece parallel to the vertical piece between the upper piece and the lower piece for connecting the upper piece to the lower piece of the shell, wherein the vertical pieces and the middle piece, together with the upper and lower pieces, defining an L-shaped mating port opposite to the L-shaped first port of the connector housing, and a rectangular mating port opposite to the rectangular second port of the connector housing.

6. The cable connector assembly as claimed in claim 5, wherein each said lateral portion of the connector housing comprises a slit formed at front thereof, each said vertical piece comprises a spring tab rearwardly bent therefrom and inserted in the slit of the lateral portion.

7. The cable connector assembly as claimed in claim 5, wherein the middle piece of the shell comprises at least a hole, the vertically extended partition wall of the connector housing comprises at least a protruding received in the hole when the shell assembled with the connector housing.

8. The cable connector assembly as claimed in claim 2, wherein the lower piece comprises a plurality of L-shaped spring fingers extending from rear edge thereof and electrically connected to at least one grounding conductor of the contacts.

9. The cable connector assembly as claimed in claim 1, wherein the cover comprises a first cover piece and a second cover piece assembled to the first cover with structure similar to that of the first cover piece.

10. The cable connector assembly as claimed in claim 9, wherein the pair of side portions of the first and second cover pieces all comprise a first side portion, and a second side portion, wherein the first side portion of the first cover comprises a plurality of locking bars and protrusions to respectively engage with a plurality of locking pieces and holes formed in the second side portion of the second cover piece.

11. The cable connector assembly as claimed in claim 1, wherein each locking member further comprises a spring section extending slantways from the cover retention section, a flat pushing section extending forwardly from the spring section adapted for a user operating conveniently, an L-shaped positioning section extending forwardly from the pushing section.

12. The cable connector assembly as claimed in claim 1, wherein the cable comprises four pairs of first 4-lane cables and six single-ended cables located between the first 4-lane cables, wherein each first cable comprises two pair of signal conductors, and two pair of grounding conductors located at lateral of the signal conductors.

13. The cable connector assembly as claimed in claim 1, wherein the cable connector assembly further comprises a spacer assembled to the connector housing and having a base with a plurality of through holes for allowing the tail ends of the contacts to extend therethrough, and a U-shaped positioning portion with a plurality of grooves for supporting the tail ends of the contacts.

14. The cable connector assembly as claimed in claim 13, wherein further comprising a flat board assembled to the spacer, wherein the flat board comprising a flat main portion, and a pair of ribs laterally extending from two lateral and front edges of the main portion for being received in the U-shaped positioning portion of the spacer after the cables are soldered to the contacts.

15. A cable connector assembly adapted for mating with a complementary connector, comprising:

a shell stamped and made of metal piece, comprising a rectangular upper piece, and a lower piece opposite to the upper piece, at least one of the upper piece and the lower piece comprising a plurality of spring fingers extending from one edges thereof;

a connector housing with a plurality of contacts received therein, retained in the shell and defining an L-shaped first port and a rectangular second port adapted for mating with different profiles of the complementary connector, the spring fingers of the shell electrically connected to at least one contact;

a cable electrically soldered to the contacts;

a pair of locking members retained in the connector housing adapted for locking the cable connector assembly with the complementary connector; and a cover comprising a first cover piece and a second cover assembled to the first cover piece for enclosing a rear portion of the connector housing therebetween.

16. The cable connector assembly as claimed in claim 15, wherein at least one of the upper piece and the lower piece of the shell comprises at least one hole, and the connector housing comprises at least one protrusion for locking with said hole of the shell for establishing a reliable connection therebetween.

* * * * *